US008881342B2

(12) United States Patent
Jonsson et al.

(10) Patent No.: US 8,881,342 B2
(45) Date of Patent: Nov. 11, 2014

(54) VACUUM CLEANER

(75) Inventors: Stefan Jonsson, Stockholm (SE); Jonas Beskow, Stockholm (SE)

(73) Assignee: AB Electrolux (SE)

( * ) Notice: Subject to any disclaimer, the term of this patent is extended or adjusted under 35 U.S.C. 154(b) by 1139 days.

(21) Appl. No.: 12/524,503

(22) PCT Filed: Jan. 25, 2008

(86) PCT No.: PCT/SE2008/000068

§ 371 (c)(1),
(2), (4) Date: Apr. 26, 2010

(87) PCT Pub. No.: WO2008/091203

PCT Pub. Date: Jul. 31, 2008

(65) Prior Publication Data

US 2012/0080057 A1 Apr. 5, 2012

(30) Foreign Application Priority Data

Mar. 2, 2007 (SE) ..... 0700541

(51) Int. Cl.

| | |
|---|---|
| ***A47L 9/10*** | (2006.01) |
| ***A47L 9/20*** | (2006.01) |
| ***B01D 45/18*** | (2006.01) |
| ***B01D 46/04*** | (2006.01) |
| ***A47L 9/16*** | (2006.01) |

(52) U.S. Cl.

CPC ..... *A47L 9/20* (2013.01); *A47L 9/1666* (2013.01); *A47L 9/1625* (2013.01)

USPC ..... 15/352; 55/1

(58) Field of Classification Search

USPC ..... 15/352; 55/303

See application file for complete search history.

(56) References Cited

U.S. PATENT DOCUMENTS

| | | | | |
|---|---|---|---|---|
| 2,171,248 | A * | 8/1939 | Van Berkel | 55/392 |
| 5,951,746 | A | 9/1999 | Treitz et al. | |
| 2003/0121121 | A1* | 7/2003 | Nakai et al. | 15/352 |
| 2005/0011036 | A1 | 1/2005 | McCutchen | |

(Continued)

FOREIGN PATENT DOCUMENTS

| | | |
|---|---|---|
| DE | 1001465 B | 1/1957 |
| GB | 564138 | 9/1944 |

(Continued)

OTHER PUBLICATIONS

Supplemental European Search Report for Application No. EP 08 70 5240 dated May 15, 2014.

(Continued)

*Primary Examiner* — Bryan R Muller
(74) *Attorney, Agent, or Firm* — RatnerPrestia

(57) ABSTRACT

A vacuum cleaner having a main separating unit, a filter, an auxiliary separating unit, a vacuum source adapted to generate an airstream, and airflow passages configured to operate in a vacuum cleaning mode and a filter cleaning mode. In the vacuum cleaning mode, the airflow passages are configured to direct the airstream through the main separating unit and then through the filter in a first direction, and the airflow substantially bypasses the auxiliary separating unit. In the filter cleaning mode, the airflow passages are configured to direct the airstream through the filter in a second direction, opposite the first direction, and then through the auxiliary separating unit. A method for operating a vacuum cleaner is also provided.

16 Claims, 3 Drawing Sheets

(56) References Cited

U.S. PATENT DOCUMENTS

| | | | | |
|---|---|---|---|---|
| 2005/0120510 | A1 | 6/2005 | Weber | |
| 2007/0056136 | A1* | 3/2007 | Stephens et al. | 15/351 |
| 2007/0125049 | A1* | 6/2007 | Menrik et al. | 55/337 |
| 2007/0209339 | A1* | 9/2007 | Conrad | 55/345 |
| 2010/0306955 | A1 | 12/2010 | Menrik et al. | |

FOREIGN PATENT DOCUMENTS

| | | | |
|---|---|---|---|
| JP | 2005-065770 | | 3/2005 |
| KR | 20060117966 | | 11/2006 |
| WO | WO 8502528 | A1 | 6/1985 |
| WO | WO2004/100752 | | 11/2004 |
| WO | WO 2004100752 | A1 | 11/2004 |
| WO | WO2005053497 | | 6/2005 |
| WO | WO 2005053497 | A1 | 6/2005 |

OTHER PUBLICATIONS

Translation of Korean Office Action for Korean Application No. 10-2009-7016069 dated Dec. 16, 2013.

* cited by examiner

VACUUM CLEANER

TECHNICAL FIELD

The present disclosure relates to a vacuum cleaner comprising a main separating unit, a vacuum source for creating a negative air pressure, and a downstream filter. The vacuum cleaner is configured to operate in a vacuum cleaning mode, wherein the vacuum source is connected to the separating unit to force a dust laden airstream therethrough in order to separate dust from the airstream, and the downstream filter is connected between the separating unit and the vacuum source to receive the airstream in a forward direction for filtering remaining dust therefrom. The vacuum cleaner is switchable to a filter cleaning mode, wherein the vacuum source is connected to the downstream filter to force an airstream therethrough in a reverse direction in order to remove dust from the downstream filter. The present invention also relates to a method for cleaning a downstream filter of a vacuum cleaner.

BACKGROUND

A vacuum cleaner is disclosed in WO 2005/053497 A1. In that document, two downstream filters are used, and when one is clogged by fine dust the user may switch the placement of the filters to clean the clogged filter using the separating unit and the other downstream filter. The cleaned filter is then ready for use when the other filter becomes clogged.

One problem with this vacuum cleaner is that the user may forget to clean the filter or may find the process somewhat cumbersome.

SUMMARY

An exemplary object of the present disclosure is to wholly or partly obviate the problem described above. This object may be achieved by embodiments of the invention according to one or more of the appended claims.

In one exemplary aspect, there is provided a vacuum cleaner having a main separating unit, a filter, an auxiliary separating unit, a vacuum source adapted to generate an airstream, and airflow passages configured to operate in a vacuum cleaning mode and a filter cleaning mode. In the vacuum cleaning mode, the airflow passages are configured to direct the airstream through the main separating unit and then through the filter in a first direction, and the airflow substantially bypasses the auxiliary separating unit. In the filter cleaning mode, the airflow passages are configured to direct the airstream through the filter in a second direction, opposite the first direction, and then through the auxiliary separating unit.

In another exemplary aspect, there is provided a method for operating a vacuum cleaner having a main separating unit, an auxiliary separating unit, and a filter. The method includes collecting dirt in the vacuum cleaner by forcing a dust-laden air stream through the main separating unit in order to separate a first amount of dust from the air stream, then forcing the air stream leaving the main separating unit through the filter in a forward direction to filter a second amount of dust from the dust-laden air stream. The method also includes removing at least a portion of the second amount of dust from the filter by forcing a cleaning air stream through the filter in a reverse direction to remove a third amount of dust from the downstream filter, then forcing the cleaning air stream through the auxiliary separating unit to separate a fourth amount of dust from the cleaning air stream from the airstream.

Other aspects and features are described more fully herein, and the present summary of the invention is not intended to limit the claimed invention in any way.

BRIEF DESCRIPTION OF THE DRAWINGS

Exemplary embodiments of the invention are described herein with reference to the attached drawings in which.

DETAILED DESCRIPTION OF EXEMPLARY EMBODIMENTS OF THE INVENTION

Figure 1:
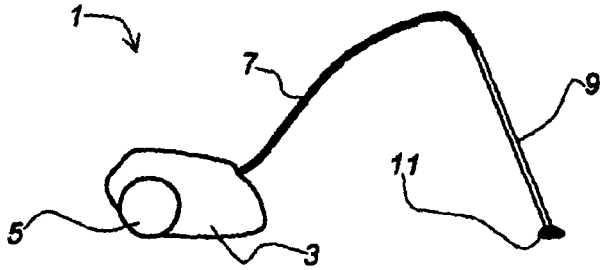
FIG. 1 shows an exemplary vacuum cleaner.

FIG. 1 shows a vacuum cleaner 1 of the canister or cylinder type. The vacuum cleaner comprises a main part 3, having a vacuum source and a separating unit (not shown). The main part may comprise wheels 5 to provide improved moveability, and may, via a flexible tube 7 and a stiff tube 9, be connected to a nozzle 11 that is capable of picking up dust from floors and carpets, etc.

The present disclosure is relevant also for upright types of vacuum cleaners, where the main part is provided integrated with the stiff tube, and for stationary vacuum cleaners which may be provided as fixed installations in buildings.

Figure 2:
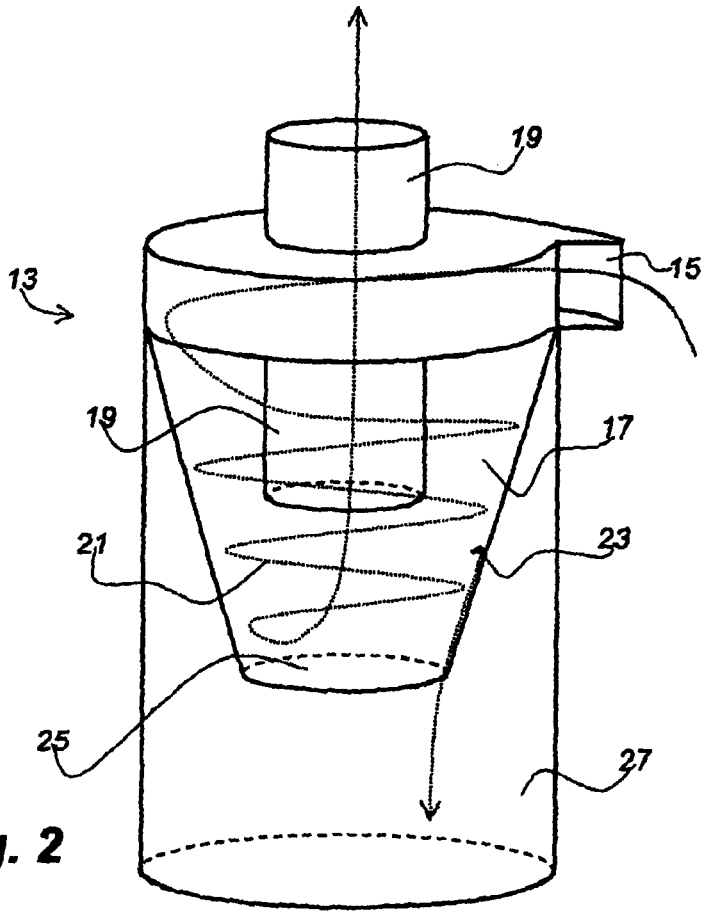
FIG. 2 schematically illustrates a typical vacuum cleaner cyclone.

FIG. 2 illustrates schematically a cyclone 13 which may be used as a separating unit in the vacuum cleaner of the present disclosure. The cyclone 13 has an inlet slot 15, through which dust laden air enters into a vortex chamber 17, which may have a substantially circular cross section perpendicular to the vertical direction, as illustrated in FIG. 2. The dust laden air enters along a tangential direction at the periphery of the vortex chamber 17, and is sucked out of the vortex chamber 17 through an outlet tube 19, which is inserted in the centre of the vortex chamber 17. This makes the dust laden air flow in a vortex 21 through the vortex chamber 17. Dust particles 23 are therefore subjected to a centrifugal force generally according to the equation $V^2/R$, where V is the flow velocity and R is the diameter of the vortex chamber cross section, which forces the particles towards the vortex chamber side wall. Once a dust particle 23 reaches the wall, it is caught in a secondary airstream directed downwards in the figure, and falls through an opening 25 in the bottom part of the vortex chamber 17 and into a dust chamber 27.

The dust chamber 27 may be conveniently emptied by the user of the vacuum cleaner, and the use of a cyclone of this kind may obviate the need for conventional vacuum cleaner filter bags.

In the illustrated cyclone 13, the vortex chamber 17 has a cross-section which tapers in the downward direction and has a minimum cross section at the opening. More particularly, the vortex chamber has a frustoconical shape. However, it should be noted that other tapering forms as well as cylindrical, non-tapering forms may be considered in a cyclone vortex chamber.

Often, a cyclone or a separating unit of another type will have a trade-off between separation efficiency and flow resistance, the higher the efficiency the higher the resistance. Therefore, for example, if a cyclone capable of providing a very high separation efficiency/ratio for a standard dust would be used, the flow resistance would be too high to provide an acceptable airflow in the nozzle (11, FIG. 1) of the vacuum cleaner with a regular vacuum source. Therefore the vacuum cleaner would not be capable of picking up dust from a floor or a carpet in an acceptable manner. An example of a standard dust is DMT TEST DUST TYPE 8® referred to in DIN IEG 60312.

In practice, therefore, a cyclone with a lower flow resistance is used, and any remaining dust which is sucked out through the outlet tube 19 is instead removed with a downstream filter in order to protect the vacuum source. Usually it is the finer dust fraction that remains to be filtered, as heavier particles are subjected to greater centrifugal forces. The term downstream filter refers to the filter being placed after the main separator but before the vacuum source in a vacuum cleaning mode.

There will now be described a vacuum cleaner with means for cleaning such a downstream filter, whereby clogging of the filter may be avoided to a great extent. To do so, the vacuum cleaner is switched from the usual vacuum cleaning mode to a filter cleaning mode. This may be done manually or automatically.

Figure 3A:
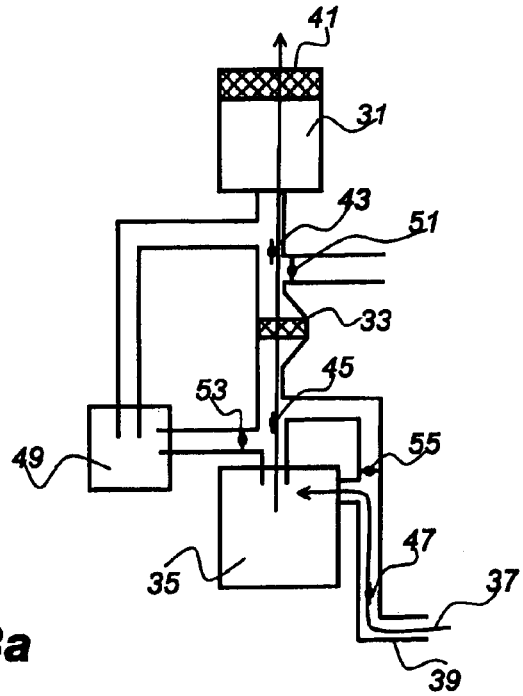
FIG. 3*a* illustrates an exemplary embodiment of a vacuum cleaner in a vacuum cleaning mode.
Figure 3B:
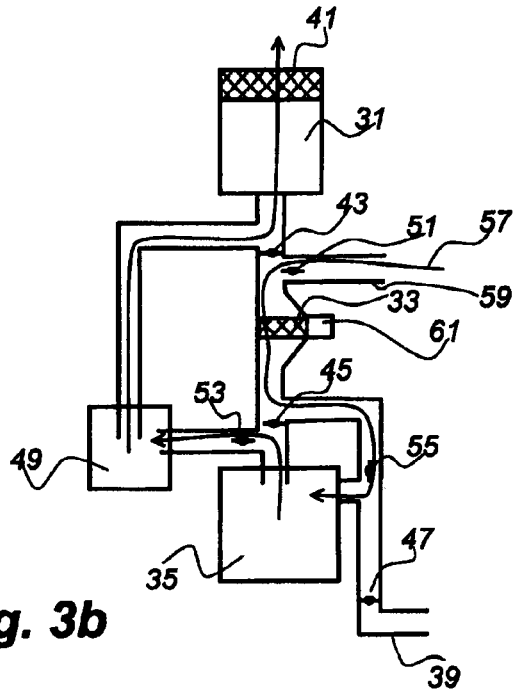
FIG. 3*b* illustrates the vacuum cleaner of FIG. 3*a* in a filter cleaning mode.

FIG. 3*a* schematically illustrates a vacuum cleaner in a vacuum cleaning mode, when the vacuum cleaner is used for vacuum cleaning, and FIG. 3*b* illustrates the vacuum cleaner of FIG. 3*a* in a filter cleaning mode. In this exemplary embodiment, the vacuum cleaner has an auxiliary separating unit. In the vacuum cleaning mode, the auxiliary separating unit is bypassed, and in the filter cleaning mode, the auxiliary separating unit is connected between the downstream filter and the vacuum source to separate dust released by the downstream filter, from the airstream.

Referring to both FIG. 3*a* and FIG. 3*b*, the vacuum cleaner has a vacuum source 31, typically comprising a fan driven by an electric motor, which creates a negative air pressure in order to make the vacuum cleaner collect dust. The vacuum source 31 is, via a downstream filter 33 connected to a main separating unit 35, which may comprise, for example, a cyclone as described above, or one or several cyclone separators of equal or different vortex diameters. Where several cyclone separators are used, the several cyclones of the main separating unit may be connected in series and/or in parallel. A dust laden airstream 37 is drawn into the main separating unit 35 through an inlet 39, which is typically connected to the flexible tube (7, FIG. 1) if the vacuum cleaner is of the canister type. Most of the dust is thereby separated from the airstream 37. Any remaining dust is filtered by the downstream filter 33, through which the airstream passes in a forward direction, in order to protect the vacuum source 31 from the remaining dust, which typically consists of finer dust fractions. The airstream then passes through the vacuum source 31, and may finally be filtered by a motor filter 41 to separate, for example, graphite or carbon particles released by the motor of the vacuum source 31. The airstream of FIG. 3*a* is accomplished by opening a first set of valves 43, 45, 47. The vacuum cleaner further has an auxiliary separating unit 49. However, in the vacuum cleaning mode, this auxiliary unit is bypassed. A second set of valves 51, 53, and 55 are closed in the vacuum cleaning mode. In some embodiments the flow resistance of the auxiliary unit 49 is sufficiently higher than that of the downstream filter 33, such that there will be no substantial air flow through the auxiliary unit 49 and that the valve 53 can be dispensed with. In such an embodiment, substantial air flow through the auxiliary separating unit can be prevented by a higher flow resistance thereof than of an alternative air flow passage through the downstream filter.

In FIG. 3*b*, the vacuum cleaner has been switched to a filter cleaning mode. In the filter cleaning mode, the downstream filter is cleaned such that its flow resistance may be reduced by removing dust that may otherwise clog the filter. The vacuum cleaner is switched to the filter cleaning mode by closing the first set of valves 43, 45, 47 and opening the second set of valves 51, 53, 55. Then an ambient air airstream 57 is drawn through a filter cleaning opening 59 and passes through the downstream filter 33 in a reverse direction, such that the downstream filter may release dust into the airstream 57. This process may optionally be enhanced by means of a rapper or vibrator 61, which may vibrate or rap the downstream filter 33 in the filter cleaning mode.

Note that the layout of FIGS. 3*a* and 3*b* is only a schematic example. Other layouts are possible within the scope of the present disclosure and the functions of the valves may be achieved differently.

The airstream then passes through the main separator 35 and through the auxiliary separator 49 such that the released dust is again separated from the airstream. The airstream then passes through the vacuum source 31 and the motor filter 41. As shown, the auxiliary separating unit may, in the filter cleaning mode, be connected in series with the main separating unit, such as by placing the auxiliary separating unit connected downstream in relation to the main separating unit. This may provide excellent separation. This arrangement and process are expected to clean the downstream filter 33, such that it does not often need to be replaced. The use of an auxiliary separator may allow cleaning of a clogged downstream filter without the use of another downstream filter, as the auxiliary separator may provide for a separator configuration with a much better separation performance. This is due to the fact that a much higher separator flow resistance may be allowed in the filter cleaning mode. The auxiliary filter need not be moved, and the process may be simpler from the user's point of view. It may even be carried out automatically.

In FIG. 3*b*, an ambient air stream 57 is drawn through a filter cleaning opening 59. However, it is also possible to dispense with the filter cleaning opening 59 and to direct ambient air from the inlet 39 to the downstream filter 33 such that the air stream will pass the downstream filter 33 in a reversed direction. It would also be possible to shut all air inlets of the vacuum cleaner during the filter cleaning mode and to force air, which is already inside the vacuum cleaner, through the downstream filter 33 in the reversed direction.

In FIG. 3*b*, the main separator 35 and the auxiliary separator 49 are series connected with the auxiliary separator downstream in relation to the main separator. However, other configurations are possible, for example, the order between the separators may be replaced. It is further possible to bypass or disconnect the main separator 35 in the filter cleaning mode such there is no substantial air flow therethrough.

In the filter cleaning mode, the flow resistance of the used separators may be higher, as there is no need to collect dust comprising heavier particles from a floor or carpet. This allows the auxiliary separating unit to have a higher separation ratio for a given dust than the main separating unit, and thus makes it possible to efficiently separate the fine dust fractions released from the downstream filter. Further, the auxiliary separating unit can be especially adapted for separating from an air stream the type of dust that is caught by the downstream filter during vacuum cleaning.

If the main and auxiliary separators are series connected in the filter cleaning mode, they may but need not have similar properties, as two series connected separators have a higher separation ratio than a single separator.

If only the auxiliary separator 49 is used in the filter cleaning mode, this separator may preferably have higher separation performance for a given dust (e.g., a standard dust) and a flow generated by a given vacuum source than the main separator 35, at the cost of higher flow resistance. Higher separation performance in a cyclone may be provided by means of a cyclone, as described earlier, having a vortex chamber (17, FIG. 2) with a smaller average cross section diameter. Alternatively, for instance, the inlet slot (15, FIG. 2) may be made less wide to concentrate the flow at the vortex chamber periphery. In such an embodiment, the main separating unit may comprise a cyclone separator, and the auxiliary separating unit may comprise a cyclone separator having a vortex chamber with a smaller average diameter than a vortex chamber of the cyclone separator of the main separating unit.

It is also possible to use two or more series connected sub-separators as the auxiliary separator. The auxiliary separating unit also may comprise one or several cyclone separators of equal or different vortex diameter. The several cyclones of the auxiliary separating unit may be connected in series and/or in parallel.

Figure 4:
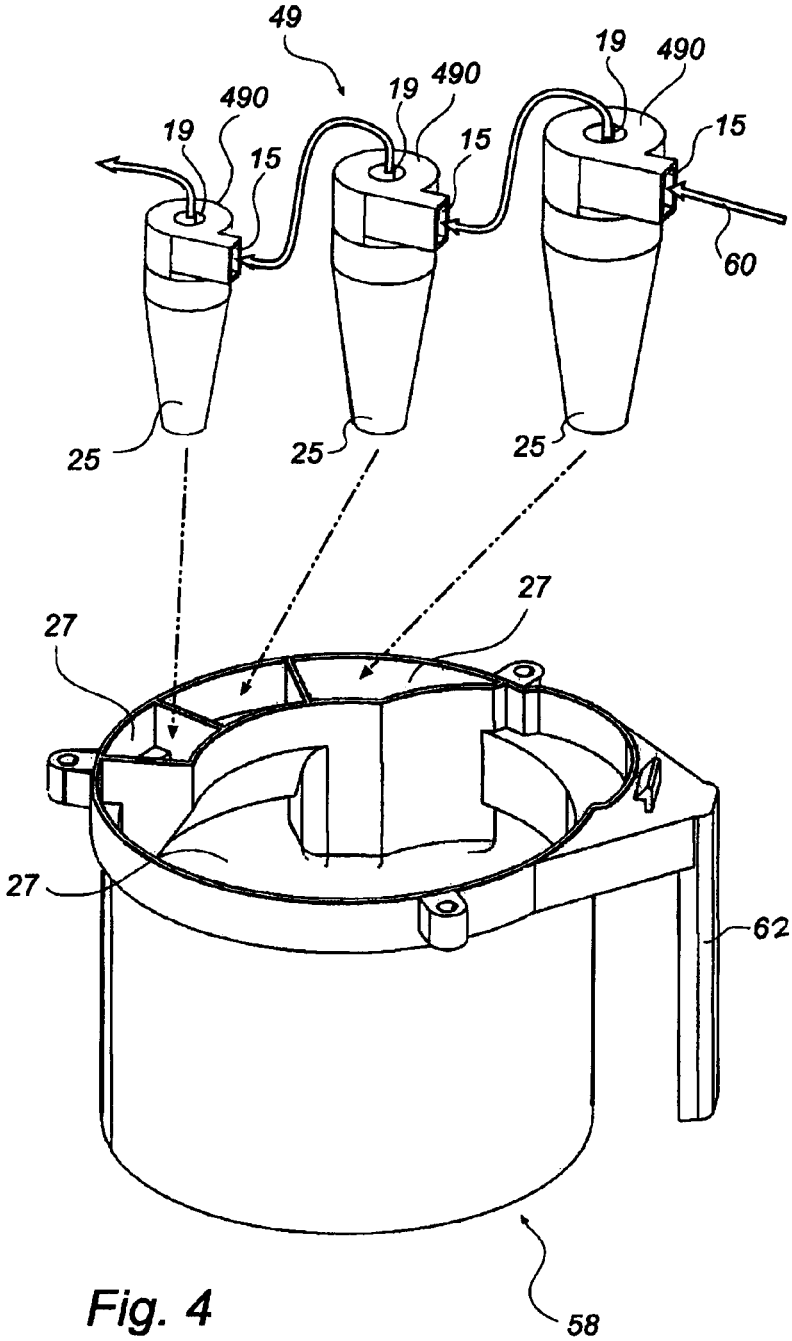
FIG. 4 illustrates an exemplary embodiment of an auxiliary separating unit and a dust bin of a vacuum cleaner.

In FIG. 4 one example of an auxiliary separating unit 49 having several sub-separators and a dust bin 58 for a vacuum cleaner according to the invention is shown. The example auxiliary separator comprises three sub-separators, which each comprises an individual filter cleaning cyclone 490. Each of the filter cleaning cyclones 490 can be of the type described above with reference to FIG. 2 and comprises an inlet slot 15, a vortex chamber, an outlet tube 19 and an opening 25 in the bottom part for separated dust. The opening in the bottom part of each cyclone 490 is connected to a separate dust chamber 27 of a dust bin 58, respectively. Each dust chamber 27 has an entrance opening, by which the respective dust chamber 27 is connected to the bottom opening 25 of the corresponding filter cleaning cyclone 490. Furthermore, the dust bin 58 includes a dust chamber 27 for the main separating unit, which comprises a vacuum cleaning cyclone (not shown). The four dust chambers 27 constitute separate compartments of the single dust bin 58. Thereby all the four dust chambers 27 can conveniently be emptied simultaneously by emptying the single dust bin 58, for example by removing the dust bin 58 from the vacuum cleaner using a handle 62 and pouring and/or shaking out the dust collected therein. The respective dust chambers 27 can be substantially fluid tight receptacles, wherein the entrance openings are connected to the bottom opening 25 of the corresponding filter cleaning cyclone 490 in a substantially fluid tight manner.

When a vacuum cleaner having an auxiliary separating unit 49 and a dust bin 58 according to FIG. 4 is operated in the filter cleaning mode, an air stream 60, which contains dust released from the downstream filter 33 (not shown), passes, in sequence, through the three, filter cleaning cyclones 490, which are connected in series. The successive cyclones 490 are arranged to filter out a different fraction of the dust respectively. As seen in the flow direction of the air stream 60, the first filter cleaning cyclone is arranged to filter out the coarsest particles, the second cyclone is arranged to filter out intermediate particles, and the third, last cyclone is arranged to filter out the finest particles. This can be achieved by arranging the cyclones with different average vortex diameters, wherein the average diameter of the first filter cleaning cyclone 490 is larger than that of the second, which in turn is larger than that of the third, last filter clearing cyclone 490. The size of each dust chamber 27 of the dust bin 58 is adapted to the amount and fraction of the dust that is separated by the corresponding cyclone 490 or the vacuum cleaning cyclone. The use of series cyclones arranged in the air stream with decreasing vortex diameter may achieve a sequential separation, wherein mainly a certain fraction of the dust is separated in each cyclone/step.

Due to the fact that each subsequent connected filter cleaning cyclone thus has a higher separation efficiency/ratio than the previous, the pressure drop over each said subsequent filter cleaning cyclones 490 is higher than that over the previous. In this regard, the embodiment with the sealed dust bin having separate dust chambers 27 for each filter cleaning cyclone 490 is advantageous. In embodiments having a common dust chamber for several, in series connected filter cleaning cyclones and/or where the dust bin is less sealed, care has to be taken in choosing cyclones with respect to their respective pressure drop in order to avoid a reversed air stream going from the common dust chamber into the first cyclone through the dust outlet opening 25 in the bottom thereof. Thereby the first filter cleaning cyclone disadvantageously draws at least part of the air through the dust outlet opening 15 instead of all air through the inlet 15. Furthermore, the second and third filter cleaning cyclones would be bypassed and would thus not contribute to separation of the auxiliary separation unit 49.

The skilled person would also realize that such a described dust bin 58 can be used in any type of vacuum cleaner that is provided with several cyclone separators, wherein the dust bin has a separate chamber/compartment for each cyclone present in the vacuum cleaner. Thus, the use of this type of dust bin is not limited to the use in the described vacuum cleaner comprising filter cleaning cyclones, but could also be used in a vacuum cleaner having several vacuum cleaning cyclones only.

Of course, many other examples and layouts of auxiliary separating units having several sub-separators are possible within the scope of the invention. For example, in series connected sub-separators in the form of cyclones need not have different average vortex diameters, but can be of equal size and performance. Furthermore, many different constructions of dust bins are possible, for example each sub-separator can be provided with an individual dust bin, which can be separately emptied, for example by being separately removable.

An electrostatic filter may also be considered as the auxiliary filter. The downstream filter 33 in this configuration may be cleaned regularly, either manually or automatically, such as when the user finishes or begins a vacuum cleaning. It is also possible to provide a pressure sensor that measures the pressure drop over the downstream filter in order to determine when filter cleaning is needed. The duration in which the vacuum cleaner is in the filter cleaning mode, or, in other words, how long the filter is subjected to filter cleaning, can be a fixed time, decided on manually or depend on the pressure drop over the filter, for example.

The downstream filter need not be able to carry a lot of dust as it can be cleaned regularly. Micro pore filters such as filter made of expanded PTFE (polytetrafluoroethylene), for example, GORE-TEX™, may be considered. On such filters the dust is collected on top of the filter surface, rather than in the depth of the filter as in a conventional filter. A micro pore filter may therefore be easily cleaned.

In the foregoing embodiment, the vacuum cleaner normally will be arranged to operate in one of the two modes—i.e., the "vacuum cleaning mode" or the "filter cleaning mode" at any given time. However, it would also be possible to direct a fraction of the air stream through the main separating unit and another fraction through the auxiliary separating unit and thereby arrange the vacuum cleaner to operate in the two modes "vacuum cleaning mode" and "filter cleaning mode" at the same time.

In summary, the present disclosure relates, in one exemplary embodiment, to a vacuum cleaner comprising a main separating unit, typically a cyclone, a vacuum source for creating a negative air pressure, and a downstream filter. The vacuum cleaner is switchable from a vacuum cleaning mode to a filter cleaning mode, where the vacuum source is connected to the downstream filter to force an airstream therethrough in a reverse direction in order to remove dust from the downstream filter, and has an auxiliary separating unit. In the vacuum cleaning mode, the auxiliary separating unit is bypassed, and in the filter cleaning mode, the auxiliary separating unit is connected between the down-stream filter and the vacuum source to separate dust, released by the downstream filter, from the airstream. This allows the downstream filter to be automatically cleaned.

The invention is not restricted to the described embodiments, and may be varied and altered within the scope of the appended claims.

The invention claimed is:

1. A vacuum cleaner comprising:

a main separating unit;

a porous filter;

an auxiliary separating unit having a higher airflow resistance than the porous filter and a higher airflow resistance that the main separating unit, and wherein the auxiliary separating unit comprises a cyclone separator, a vacuum source adapted to generate an airstream; and airflow passages configured to operate in a vacuum cleaning mode and a filter cleaning mode, wherein:

in the vacuum cleaning mode, the airflow passages are configured to direct the airstream through the main separating unit and then through the filter in a first direction, and the airflow substantially bypasses the auxiliary separating unit, and in the filter cleaning mode, the airflow passages are configured to direct the airstream through the filter in a second direction, opposite the first direction, and then through the auxiliary separating unit.

2. The vacuum cleaner of claim 1, wherein the airflow passes through the vacuum source after passing through the filter in the vacuum cleaning mode, and the airflow passes through the vacuum source after passing through the auxiliary separating unit in the filter cleaning mode.

3. The vacuum cleaner of claim 1, wherein, in the filter cleaning mode, the auxiliary separating unit is connected in series with the main separating unit.

4. The vacuum cleaner of claim 3, wherein, in the filter cleaning mode, the auxiliary separating unit is connected downstream in relation to the main separating unit.

5. The vacuum cleaner of claim 1, wherein the auxiliary separating unit has a higher separation ratio for a given dust than the main separating unit.

6. The vacuum, cleaner of claim 1, wherein the main separating unit comprises a cyclone separator.

7. The vacuum cleaner of claim 6, wherein the auxiliary separating unit comprises at least one cyclone separator having a vortex chamber with a smaller average diameter than a vortex chamber of the cyclone separator of the main separating unit.

8. The vacuum cleaner of claim 1, wherein the auxiliary separating unit comprises a plurality of sub-separators.

9. The vacuum cleaner of claim 8, wherein the auxiliary separating unit comprises three sub-separators connected in series, each sub-separator comprising a cyclone separator.

10. The vacuum cleaner of claim 9, further comprising a dust bin having a plurality of dust chambers, wherein each sub-separator is connected to a respective dust chamber.

11. The vacuum cleaner of claim 1, wherein the downstream filter comprises a micro pore filter.

12. The vacuum cleaner of claim 1, farther comprising an ambient air inlet, and wherein, in the filter cleaning mode, the airflow passages are configured to direct the airstream from the ambient air inlet to the filter.

13. The vacuum cleaner of claim 1, wherein the airflow passages comprise one or more valves adapted to selectively configure the airflow passages in the vacuum cleaning mode and the filter cleaning mode.

14. The vacuum cleaner of claim 13, wherein the one or more valves are positioned in the vacuum cleaning mode to cause the airflow to substantially bypass the auxiliary separating unit.

15. The vacuum cleaner of claim 1, wherein airflow resistance within the vacuum cleaner is higher in the filter cleaning mode than in the vacuum cleaning mode.

16. The vacuum cleaner of claim 1, wherein, in the filter cleaning mode, the airflow passages are configured so that the airstream bypasses the main separating unit.

* * * * *